US005277142A

United States Patent [19]

Connor

[11] Patent Number: 5,277,142

[45] Date of Patent: Jan. 11, 1994

[54] VARIABLE-BEAM CATAMARAN

[76] Inventor: Dennis P. Connor, 5133 Wilts Pl., San Diego, Calif. 92117

[21] Appl. No.: 786,900

[22] Filed: Nov. 1, 1991

[51] Int. Cl.[5] ..... B63B 1/00

[52] U.S. Cl. ..... 114/61; 114/283

[58] Field of Search ..... 114/61, 283, 284, 123, 114/353, 354, 39.1, 347, 121, 122, 292; 12/310

[56] References Cited

U.S. PATENT DOCUMENTS

| | | | |
|---|---|---|---|
| 2,347,959 | 5/1944 | Moore | 114/61 |
| 2,678,018 | 5/1954 | Crisp | 114/123 |
| 3,593,684 | 7/1971 | Cogliano | 114/61 |
| 3,937,166 | 2/1976 | Lindsay | 114/123 |
| 3,981,259 | 9/1976 | Harper, Jr. | 114/61 |
| 4,159,006 | 6/1979 | Thurston | 114/123 |
| 4,286,533 | 9/1981 | Sanner | 114/39 |
| 4,294,184 | 10/1981 | Heindrich | 114/61 |
| 4,337,543 | 7/1982 | VanUlzen | 114/354 |
| 4,441,445 | 4/1984 | De Weck | 114/61 |
| 4,457,248 | 7/1984 | Thurston | 114/123 |
| 4,474,128 | 10/1984 | Wallach | 114/61 |
| 4,730,570 | 3/1988 | Harris | 114/61 |
| 4,977,844 | 12/1990 | Barr | 114/123 |

FOREIGN PATENT DOCUMENTS

87/07228 12/1987 World Int. Prop. O. ..... 114/61

OTHER PUBLICATIONS 20-pages from Book "Multihulls for Cruising & Racing" 1991 © published by International Marine Inc., Camden, Me. Author-D. Harvey.

*Primary Examiner*—Robert J. Oberleitner
*Assistant Examiner*—Clifford T. Bartz
*Attorney, Agent, or Firm*—Brown, Martin, Haller & McClain

[57] ABSTRACT

An improved twin hull vessel of the catamaran type, having a central bridgedeck and a pair of side hulls interconnected by lateral suspension arms. The suspension arms are pivotally connected with offset spaced connections to the bridgedeck and to each of the hulls for moving said hulls from a substantially horizontally locked position to a vertical position beneath the bridgedeck, while holding the hulls in the vertical orientation relative to the water surface, thus changing the vessel from a catamaran to a single hull vessel for moving the vessel into pier locations, or for trailering the vessel.

3 Claims, 3 Drawing Sheets

VARIABLE-BEAM CATAMARAN

BACKGROUND OF THE INVENTION

This invention relates to multi-hulled boat configurations and outrigger type float mounting construction. In particular, it relates to catamaran-type twin-hulled boats with articulated hull suspension enabling the overall beam width of the boat to be narrowed when desired to substantially a single hull configuration.

Ocean-cruising catamarans have been known for over 3,000 years. Heretofore, such multi-hulled boats have often been difficult and awkward to maneuver in relatively tight marina berthing procedures, or in packed anchorage areas. This is primarily due to their comparatively massive beam width. Additionally, these wonderfully performing open-water craft are non transportable by motor-trailer because of their girth. Efforts have been made by inventors to overcome this particular difficulty by collapsing the hulls in various ways, generally resulting in serious design compromises. The previous improvements have been less than satisfactory.

There are two basic practical approaches to variable-beam-width catamarans. One is using telescoping transverse-tubes that slide the hulls together. The other is using pivoting swingarms that narrowingly tilts or swings the hulls inward. Otherwise, the procedure is to spend hours in dismantling or collapsing the entire vessel.

The early prior art is illustrated by U.S. Pat. No. 2,678,018, which shows a boat having dual, lateral (right and left) 3-position, stabilizing hulls. These hulls were articulated by a first set of horizontally spaced parallel arms set on a longitudinally arranged pivot-axis, which served to fold the hulls 90 degrees beneath the main center hull. In this movement, the stabilizing hulls are rotated so that the outer side contacts the surface of the water. A second set of pivot arms act on axes arranged vertically to the horizontal first set of arms, to further outset the float members on a horizontal plane of swing action. This system suffers from loss of hull configuration when the outrigger hulls are folded under the center hull, making the hulls essentially useless other than for flotation, and would tend to take on water in the rotated attitude unless fully sealed. So this configuration is inappropriate to adapt as a sea-going, cabin-hulled, the catamaran-craft configuration.

The U.S. Pat. No. 2,917,754 shows a simple light-weight catamaran configuration with laterally opposed hulls pivotally mounted to a horizontal center panel as to enable them to neatly fold above the center panel, one hull into the other. This allows the folded assembly to be readily mounted atop a car roof, for example. However, this is a simple small craft that is not adaptable to be used in a cabin-hull configuration.

U.S. Pat. No. 3,593,684 discloses a collapsible multi-purpose catamaran-type craft in which two laterally opposed hulls are slideably joined to dual transverse tubular members held by a third center section frame. Owing to the considerable physical weight involved in a larger sea-going craft, the system is only practical for small light-weight boats.

The disclosure of U.S. Pat. No. 3,937,166 shows a trimaran sailcraft having a folding-hull member pivoting upon longitudinal axes at each outermost right and left sides of the cabin structure. This is achieved without disturbing the center cabin occupancy. In this method, the hulls are cantilevered transversely out on pivot arms. However, the outboard hulls are useless for cabin occupancy or buoyancy, since they rotate about 80 degrees upon their sides when deployed into their fully retracted position. Hence, this configuration lacks the spatial volumetric efficiency which the present invention teaches elsewhere herein, whereby outrigger hulls can also provide comfortable occupancy; efficiently utilizing the otherwise dead-weight, draft drag imposed by the stabilizer hulls of this old art.

The invention of U.S. Pat. No. 3,981,259 shows a small fishing catamaran having dual, extensible hulls, which pivot 90 degrees laterally on spaced longitudinal axes so as to be swung inward beneath the planar mid-frame (supporting a cabin) or outward from the mid-frame, as controlled by telescopic rams. Because of the swinging arrangement, the hull design is only vertical to the water at mid-position; and thus would not provide suitable cabin occupancy because only the center platform remains horizontal to the water. A so-called collapsible catamaran is shown in U.S. Pat. No. 3,986,219, which is a small light-weight embodiment having a horizontal rectangular tube framework with quick disconnects which enable the boat to be taken apart in sections and packed in one compact package if desired. But there is no provision for varying the beam width. While U.S. Pat. No. 4,286,533 shows a catamaran featuring a transversely fixed overall hull beam, the center flying platform is able to be moved laterally thereto, enabling a sailor to bias the deck to one side or the other so as to weightably counteract the force of the wind.

A tri-hulled sailing craft is shown in U.S. Pat. No. 4,294,184 which exhibits variable hull beam width capability by means of laterally spaced, pivot arms acting on longitudinal axes. Yet here again the hulls become undesirably inverted some 180 degrees when swung through their full swing limit, making the hulls unusable for cabin occupancy. A rather barge-like trimaran boat is shown in U.S. Pat. No. 4,337,543, wherein a solid planar deck is exhibited having two longitudinal pivot axes at the deck enabling the laterally spaced outer quarter sections of the hull to be manually pivoted 90 degrees beneath the hull center section, thereby achieving more compact storage.

In U.S. Pat. No. 4,441,445 the trimaran sailboat has laterally well spaced, articulated outrigger hulls powered by telescopic rams, the purpose being to enable the boat to right itself if it should become inverted while sailing in high wind conditions. Again, the arrangement uses opposed right and left transverse arms having longitudinal pivots, but the axes are set well outboard of the center hull so that the floats carried distally on the arms may be moved by telescopic rams some 220 degrees in order to perform a self righting action.

In U.S. Pat. No. 4,730,570, a variable beam trimaran is set forth employing outrigger floats which are connected to the center hull by means of several discrete transverse support tubes. This sliding tube arrangement facilitates narrowing of the overall beam width, yet seriously interferes with cabin occupancy space in the center main hull.

More recently, U.S. Pat. No. 4,766,830 discloses a simple lightweight catamaran that readily disassembles rather than function as a variable beam. Another U.S. Pat. No. 4,807,551, shows an ordinary canoe boat, adapted with a simple arrangement of dual transverse tubes secured to the hull at both sides, and a pontoon float set distally outboard therefrom. Finally, U.S. Pat.

No. 4,977,844 shows a simple rowboat adapted with a single lateral arm member having a narrow curved float that retracts closely against the side of the likewise curved hull side.

It is clear from the prior art and a survey of the marketplace that there are presently no catamaran vessels of practical sea-going configuration capable of meeting the popular needs of the sailing public, either as to a practical, readily variable hull beam width, or one which when retracted still maintains a constant vertical attitude to the cabin area within the laterally opposed hulls. Therefore, the present invention herein disclosed a high performance catamaran both in sailboat and powerboat embodiments.

SUMMARY OF THE INVENTION

This invention provides a catamaran power boat or sailboat having excellent sea-going, anti-roll performance along with greatly improved maneuverability in more confined conditions such as in crowded marinas and particularly when engaging in a berthing procedure. Ordinary catamarans are desirable in their ability to resist heeling over in the open sea but unpopular in a marina, since they either occupy two berthing slips, or must be moored across the outer end of the dock, where the more open space makes for better accommodation. The special dual, parallelogram linkage arrangement of this invention enables the dual, laterally opposed hull units to be extended outward from the center of the vessel, or retracted inward below the center deck section to which the linkages are coupled. This reduces the otherwise often ungainly beam width by about one-half, enabling this vessel to be berthed in an ordinary boat slip.

Another object of this invention is to provide an improved catamaran sailboat having more practical cabin comfort in the outer hulls, because the hulls always remain perpendicular to a calm water surface regardless of the particular disposition of the special hull beam width. This is uniquely achieved by the special parallelogram linkage operation.

Another object of this invention is to provide a catamaran sailboat which may be adapted to sizing from a one-man, 15-footer on up to popular multi-place sizes of 28 feet and more, where the laterally opposed hulls are of sufficient size to accommodate several persons in each hull cabin. By way of comparison, the currently most popular retractable outrigger, as shown in U.S. Pat. No. 3,937,166 at about 27 feet in length, sleeps 4 to 5 persons. The same length boat of this invention is able to suitably sleep 8 to 10 persons when provided with the bridgedeck cabin in addition to the hull cabins. The hulls can be laterally deployed through an approximate 90-degree, radial, suspension arm, swing arc from approximately horizontal to approximately vertical relative to the bridgedeck, with the hulls being continuously, vertically oriented.

Another object of this invention is to provide a flying bridgedeck, center section to which the laterally disposed hull units are attached by the dual parallelogram, pivotal linkage arrangement, providing a rigid, locked-in-place, outward deployment. This center structure is preferably rigid in torsional construction and may simply be a horizontal deck of substantially rectangular plan view formation; or, in a more elaborate embodiment, the center section may include a full stand-up enclosed cabin of weather-tight design, including a full range of cockpit controls.

Another object of this invention is to provide a catamaran having a variable hull system, whereby either the right or left side dual, parallelogram linkage system may be discretely adjusted as to angular position relative to the special ability to effectively bank the entire bridgedeck on a longitudinal axis either to port or starboard.

Another object of this invention is to set forth a special transversely-staggered arrangement of each lateral right and left dual, parallelogram linkage system in which the front and rear upper links on each side are disposed somewhat outwardly from their respective front and rear lower links, and where each link is rigid providing a composite rigid support for the outer hulls.

In each upper link, there is an outset upper arm poised immediately above a slightly inset lower arm. This linkage-arm relationship allows the outer end of the upper arm to be pivotally connected to the top center of the hulls' frontal cross-section, and the outer end of the lower arm to be pivotally connected to the inward facing surface of the hull's sidewall. The preferably equal length arms are connected front to rear at spaced intervals, making a similar pivot joint connections at one end to the bridgedeck and at the other end to the hulls at the longitudinal, spaced locations.

This special laterally staggered linkages enable the opposed hull units to be positioned anywhere between fully, outwardly deployed to fully inwardly retracted, by movement of only one arm in each parallelogram linkage suspension, while continuously holding the hulls in a vertical position. Accordingly, in the ultimately retracted position, the hulls preferably become poised nearly together beneath the center bridgedeck section, thereby effectively raising the bridgedeck from its normal unwetted hull height above the water surface to the distance substantially equal to the length of the suspension arms, providing an advantageous viewpoint from the flying bridgedeck cabin during marina docking.

Another object of this invention is to provide a basically low cost system to either manually, semi-automatically, or automatically retract the port and starboard hulls, preferably in a simultaneous manner. A special cable winching system is thus provided, whereby in the preferred embodiment the winching pully axis is preferably arranged transversely while mounted somewhere about midship within the bridgedeck. This system can include a dual, pull-cable arrangement. This allows individual cables wound upon a common windlass to be routed, one to a bow idler pully and the other to a stern idler pully, at which point the cables each continue on laterally outward to anchoring points, sufficiently outboard of the lower suspension arms inboard pivot axis so as to attain the required amount of leverage. Hence, this pull-cable arrangement uniformly biases both front and rear suspension arms pairs through a finite articulation range from the extended to the retracted position.

Since in some embodiments of the invention the suspension arms will actually be swung inwardly slightly passed a vertical incidence of angularity relative to the water surface, and function to restrain the hulls in this position, it is desirable to include an initial biasing device preferably in the form of a simple leaf tension spring which becomes loaded as the lower suspension arm approaches the vertical attitude. Thus, when it is desired to widen the hull beam width, the winch pully is released to unwind and the springs at the bow and stern provide the force to actually move the suspension arms laterally outward as permitted by the controlled slack in the cables. As the suspension arms move outward to a sufficient degree of vertical angularity, the weight of the bridgedeck becomes the continuing biasing impetus.

In order to achieve remote servo control over the articulated hulls, as well as maintain a substantially rigid longitudinal alignment (bow-to-stern anti-splay parallelism) between both the laterally opposed hulls and the hulls relative to the bridgedeck center section, a special coordinated system of substantially conventional hydraulic ram units are coupled between the bridgedeck and each of the paired bow and stern suspension arm members. The hydraulic rams are positionally mounted either interposed from one suspension arm to the other, or from the bridgedeck to one of the suspension arms, to exert an instantly responsive biasing force in response to a conventional hydraulic pump. The hydraulic circuit is preferably arranged with substantially conventional valving controls, which move both port and starboard hull members simultaneously. While it is preferred that the hydraulic system be electrically operated, the system can be more sportingly manually pumped in brisk fashion via a substantially conventional rotary pump with a hand crank.

Further rigidizing of the float hulls relative to the bridgedeck is readily accomplished with the hulls in their fully extended horizontal position by means of anchor bolts secured through the upper arms into the lower arms. This locks the two cooperating arms together in an integral manner until the fasteners are removed. Some builders may prefer to employ a "purist sailor" system, in the form of a manually crankable gear box, whereby manual dexterity is briskly applied to readjust the hulls to a selectively desired position (at least as a precautionary back up).

DESCRIPTION OF THE PREFERRED EMBODIMENT

ITEMIZED NOMENCLATURE REFERENCES

Figure 1:
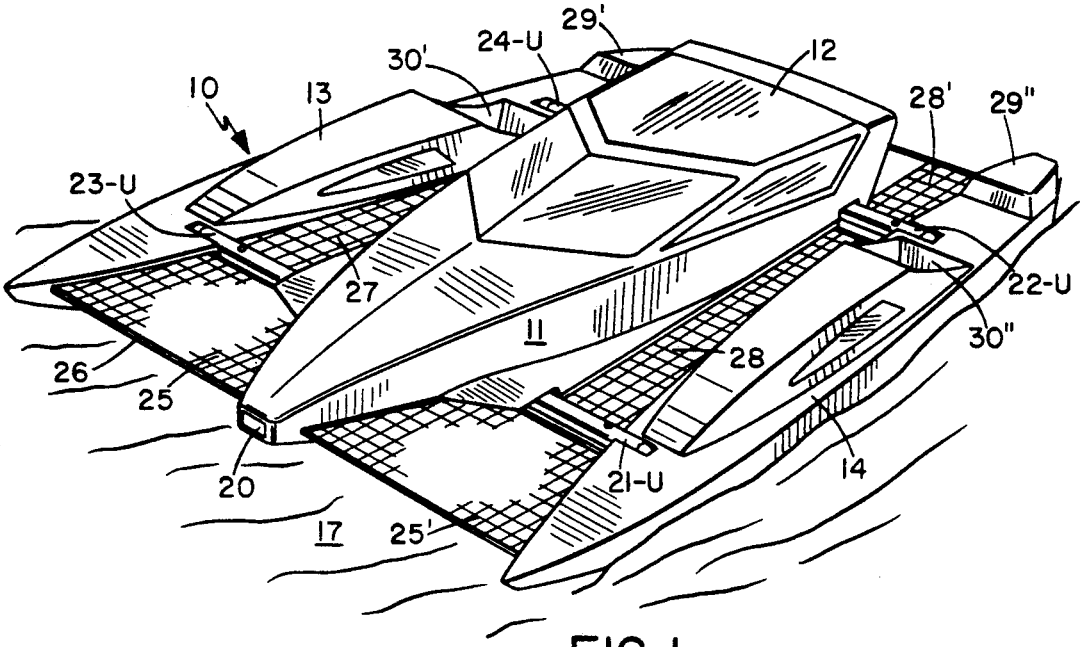
FIG. 1 is a frontal pictorial perspective view of an exemplified embodiment of the invention.

10—the overall vessel
11/11'/11''—overall bridgedeck structure, lower port bow, lower port stern portions
12—bridgedeck roof
13—starboard roof
14—port roof
15/15'/15''—starboard hull positions
16/16'—port hull positions
17/17'/17''—varying water surface
18—air space gap
19—center hull (dry)
20—bowlight
21-U, 21-U'/21-L, 21-L''—port bow upper, lower arm positions
22-U, 22-U', 22-U''/22-L, 22-L', 22-L''—port stern upper, lower arm positions
23-U/23-L—starboard bow suspension arms (upper and lower)
24-U/24-L—starboard stern suspension arms (upper and lower)
25/25'—bow crew support netting (port and starboard)
26—bow net suspension cable
27—starboard mid support netting
28/28'—port support netting (mid and stern)
29/29'—engine covers (starboard and port)
30/30'/30''—helm stations (center, starboard and port)
31, 31'—lower arm, upper arm pivot axes
32, 32'—port bow, stern receptor channel reinforcement cavity areas
33—retention bolt
34—threaded boss
35—kicker spring (leaf)
36, 36', 36''—winch drum, crank arm, second cable
37—idler pully
38, 38', 38''—winch cable, cable anchorpoint, anchorpoint retracted
39—bolt mounting both winch and spring
40, 40', 40''—mast, mainsail, spinaker sail
41/41'—canvas windbreak
42—clear vinyl windshield
43, 43', 43''—hydraulic rams, ram rod, and rod retract position
44—ram rod outer pivot point
45—hydraulic servo pump and reservoir
46, 46', 46''—starboard T-feeder line, ram branch lines
47, 47'—additional starboard ram branch lines
48, 48', 48''—3-way solenoid valves, 2-way port and starboard valves
49/49'—bow and stern transverse hull beams

DETAILED DESCRIPTION OF THE PREFERRED EMBODIMENT

Figure 2:
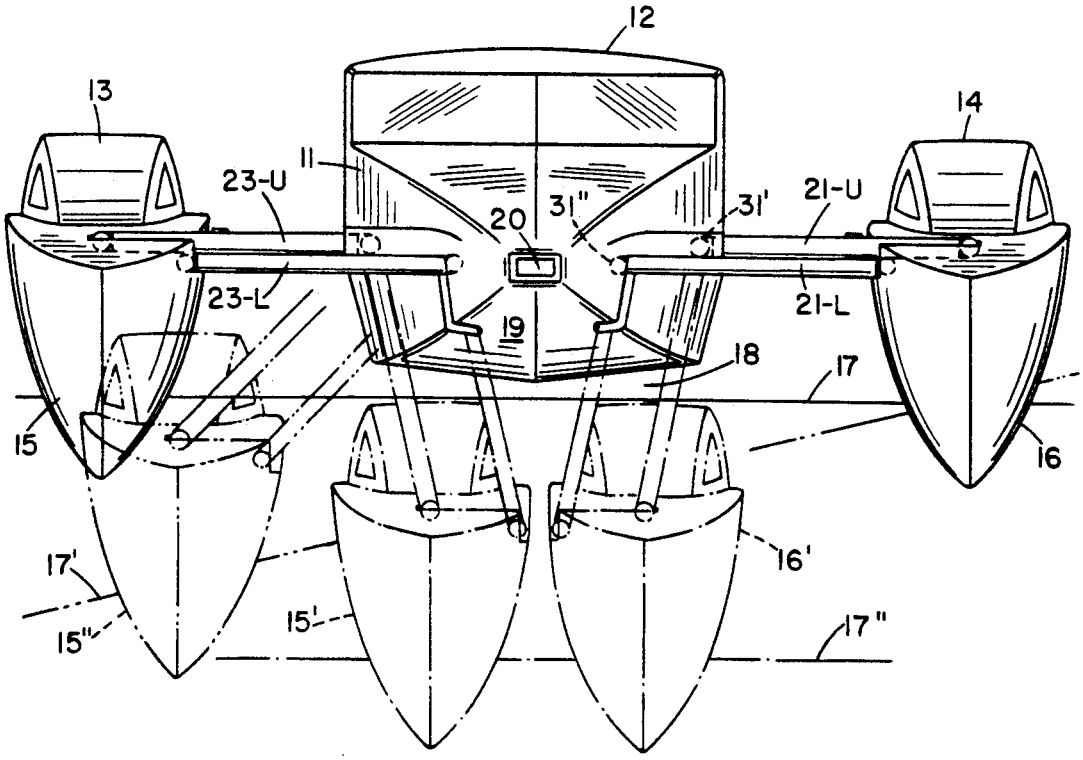
FIG. 2 is an enlarged front elevation view showing alternate hull suspension modes in phantom outline.

Referring to FIG. 1, a tricabin cruiser-style catamaran vessel 10 may have in an illustrative embodiment a length of 28 feet and a beam of 22 feet, with a large center bridgedeck section 11 of 8 feet width. The same craft appears in FIG. 2, and is illustrated to accommodate a 6-foot tall person in any of three cabin spaces: under the center roof 12, beneath starboard roof 13, and beneath the port roof area 14. In the sense of a pure catamaran craft, only the outrigged symmetrical (hydro-dynamically speaking) hulls 15, starboard, and 16, port, are actually wetted in buoyancy of the vessel via water surface 17. Yet in this embodiment only a minimal clearance of air space 18 is provided beneath center hull 19, in order to maintain a sleek low overall profile height. In FIGS. 1 and 2, the generally preferred over and under positioning of the laterally extended hull suspension arms are arranged in pairs 21 and 22 (port), 23 and 24 (starboard).

Other features of FIG. 1 include an optional built-in bowlight 20 and crew support netting 25 and 25', which is simply suspended at the leading edge via bow cable 26 which can be a nylon rope, as well as between the respective adjoining vertical hull surfaces at 28. Similar netting 28' can be employed aftwardly at the stern. This netting can serve to reduce the bridgedeck undersurface being subject to wave pounding, hence improving the ride at speed. Powerful outboard motors are housed beneath the covers 29'/29" and separate rudders are also situated there (not shown). This eliminates the much less desirable arrangement of propeller and rudder members attached to the bridgedeck 11 which would necessarily need to extend downward when the craft's outboard hulls 13 and 14 are in retracted position as illustrated in FIG. 2, where the bridgedeck is above the water surface 17.

On retracting the hulls 13 and 14, the bridgedeck structure becomes elevated immediately above (refer to new water line 11). This is how the vessel would normally appear at dockside with the hulls almost contacting. The hulls may be spaced about one hull width apart if greater stability is desired at dockside or at open anchorage. Thus it may be readily understood from FIG. 2 how the narrowed vessel may be berthed into a conventional boat slip, as well as easily trailered at the maximum width normally permitted. The action of the specially articulated parallelogram linkage, or suspension arms, serves to continuously position the hulls perpendicular to the water, or in a vertical position relative to the water surface, as the hulls are being fully extended, retracted, or anywhere therebetween. While this is a feature of the invention, different retracting of one of the hulls relative to hulls on the other side of the bridgedeck 11 can cause some angling of the hulls from vertical, as can also occur from wave action.

Also as illustrated in FIG. 2, as the craft enters a sharp turn the outside swing arms can lower to an approximate 45-degree angle from the horizontal, thus dropping the outside hull 15 to position 15". This causes the craft to effectively bank into a turn (refer to relative water surface line 17) like a conventional monohull craft. This is not possible with conventional powercats which go through turns in a substantially flat attitude, owing to their widely spaced buoyancy points. Note in the frontal view of FIG. 2 how the upper arm pivot points are preferably located substantially outboard and in the case of this exemplified 28-foot embodiment, rest just in from the maximum width of the bridgedeck at 31'. The 5.5-foot pivot spread on the hull places the outer pivot 41" at the upper hull center line. The lower suspension arm is of the same length between pivots and about 22 inches inboard of the upper arm, and is just within the maximum inward-facing hull width. This arrangement makes the hulls nicely retractable in near siamesed fashion, while keeping the hulls in a desirable perpendicular attitude.

Figure 3:
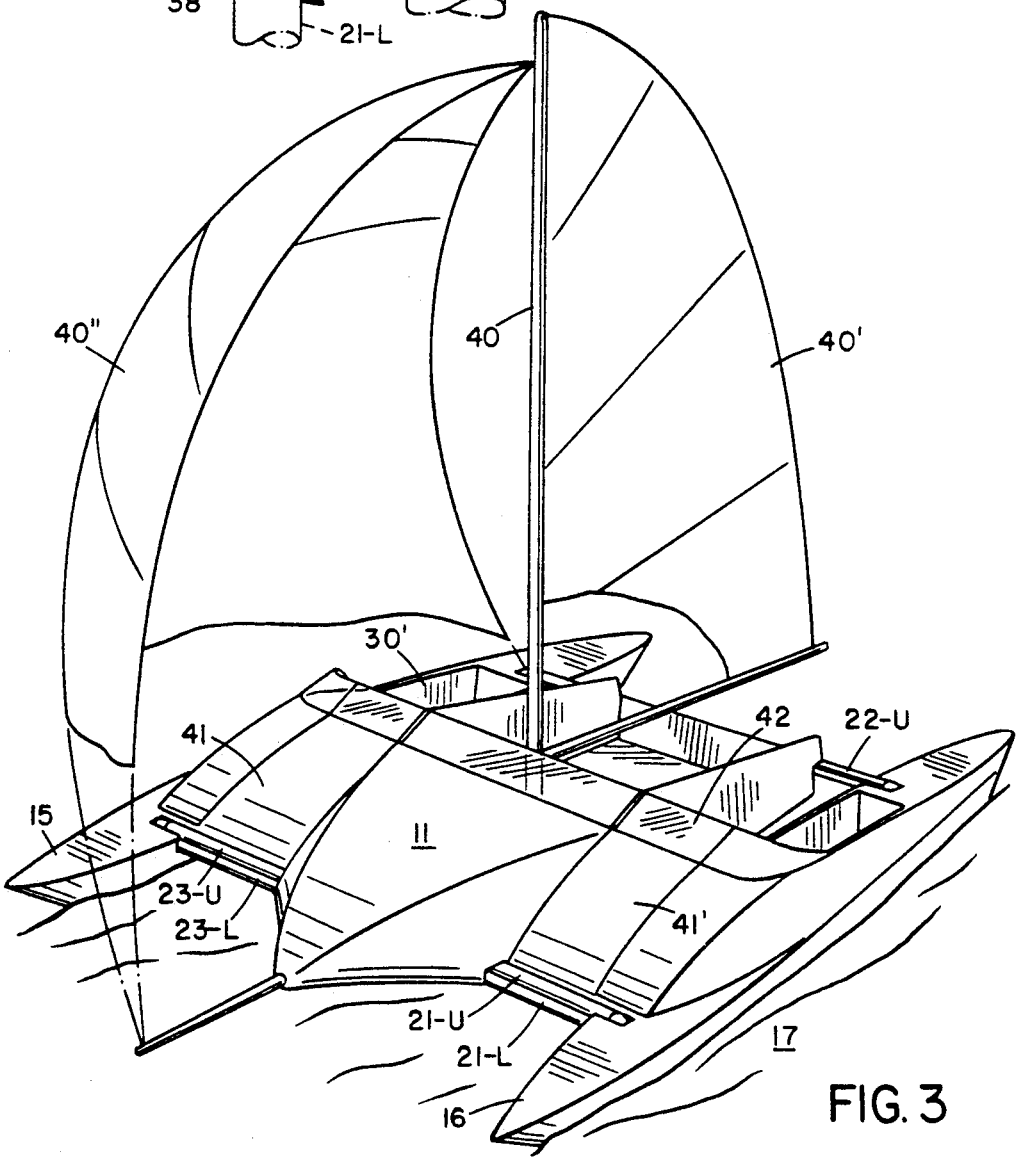
FIG. 3 is a frontal pictorial perspective view of another embodiment of the invention.

Referring to FIG. 3, the exemplified sailcat embodiment has a mast 40 (usually a folding-mast rigging with stay cables not shown), main sail 40' and spinaker sail 40", mounted into the bridgedeck 11. Again we see that the hulls 15 and 16 serve as crew quarters, while in this embodiment the bridgedeck serves as the main operating station and lounge area. Also shown are canvas windbreak panels 41 and 41' having likewise flexible vinyl windshields 42, all of which readily detach via conventional fastening means such as zippers or Velcro® (hook and loop) when it is desired to go into either partial or full hull retraction.

Figure 4:
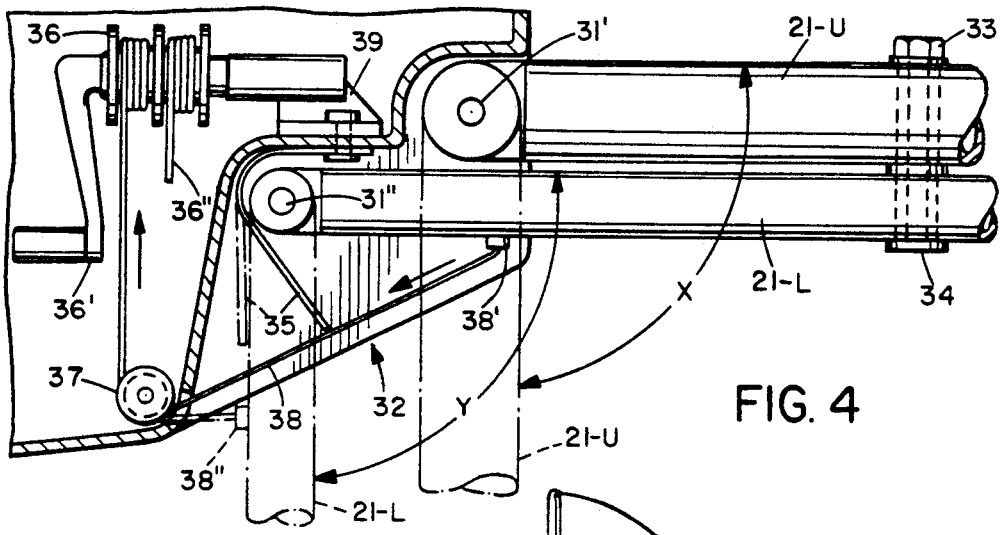
FIG. 4 is a frontal elevation view enlarged to show the essential component layout of the side inboard suspension arm arrangement, including an exemplified winch control system.

With the suspension arms are adapted to control the lateral hull positioning into at least two extreme modes of operation (extend and retract), it may be understood that these hull positions can be changed substantially, manually in the lighter weight vessel embodiments. In larger embodiments, it is desirable to mechanically power the linkage movements. In FIG. 4 there is illustrated the upper suspension arm 21-U and lower suspension arm 21-L which pivot upon inboard axes 31' and 32" respectively, to swing downward 90 degrees or more in some installations as indicated by arc arrows X and Y respectively. The lower longitudinal portion of the bridgedeck structure 19 serves to support mounting of the respective pivots or couplings, including a kicker spring 35 which acts to assure initial outward movement of the suspension arms when required. As observed in their horizontally extended attitude, the top surface of suspension arm 21-L is preferably, intimately impinged against the lower surface of suspension arm 21-U, and it is additionally preferred that during actual sailing operation, an upper retention bolt 33 can be screwed into a lower threaded boss 34 so as to attain rigid integrity of the assembly; although a clamping arrangement could be similarly implemented to hold the suspension arms together.

When the positioning means just described is released, the winch hub 36 is either motor or hand crank 36' actuated so as to simultaneously tension winch cable 36" (extending similarly aftward to suspension arms 22-U and 22-L not seen here) and winch cable 38 toward the hub 36, thereby retracting the suspension arms 21-L (lower) and 21-U (upper) 90 degrees down and inward (via arcs X and Y respectively) to a suitable berthing or trailering position as illustrated in FIG. 2. Note here that the suspension arms are pivotally anchored to the bridgedeck structure 11 at station points 31' and 32", and are preferably further supported within the receptor channel 32 which has side walls that act as pocket bearing surfaces, so as to better resist both longitudinal and lateral thrust loads imposed either by water drag or contact during beaching or docking procedures, for example. The idler pully 37 acts to redirect routing of the cable 38 and the cable end 38' may be secured to the arm 21-L by any one of various known attachment methods. When it is desired to again extend the hull 14 (not seen in this view), the initial movement of the hulls is preferably achieved by means of the simple kicker spring 35, which became tensioned by arm 21-L as it approached the retracted position 24-L'.

Figure 5:
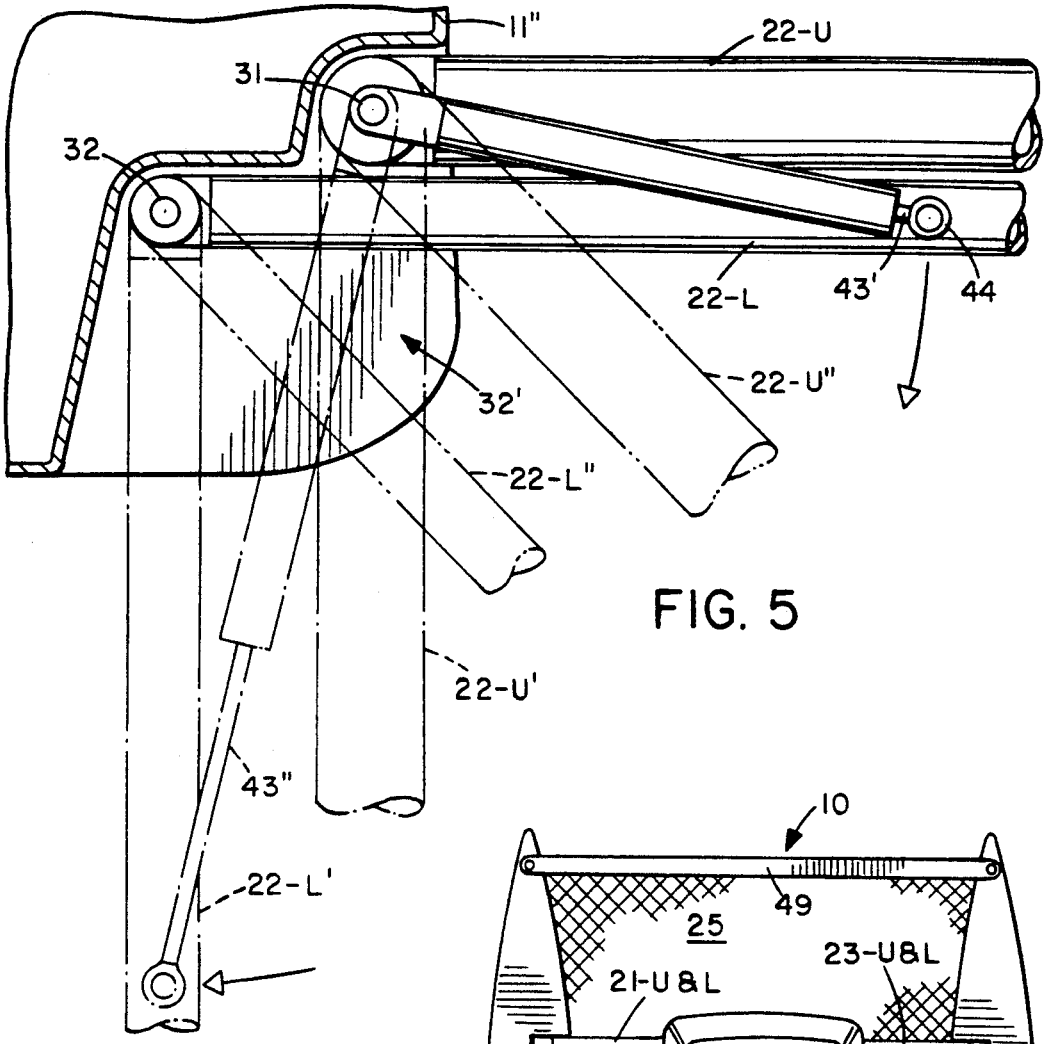
FIG. 5 is a frontal elevation view similar to the preceding illustration, showing an essential layout of the port side inboard suspension arm arrangement, but illustrating an exemplified hydraulic control system.

A still more convenient control system is illustrated in FIG. 5. The suspension arms 22-U and 22-L are attached to the lower bridgedeck quadrant 11", within the preferred reinforcement of receptor channel cavity 32'. Generally, the arms are capable of swinging some 90 degrees downward to positions 22-U' and 22-L' by telescopic expansion of substantially conventional hydraulic ram units 43 having stainless steel single stage, piston ram shafts 43' pivotally secured both inwardly and outwardly at some suitable locations such as points 31 and 44, thereby able to exert a powerful biasing force upon the suspension arms to reposition the arms virtually anywhere within the designed arc sector such as shown. Naturally, even greater swing arcs are obtainable when the suspension arm pivots are somewhat repositioned, for such special applications such as the racing.

Figure 6:
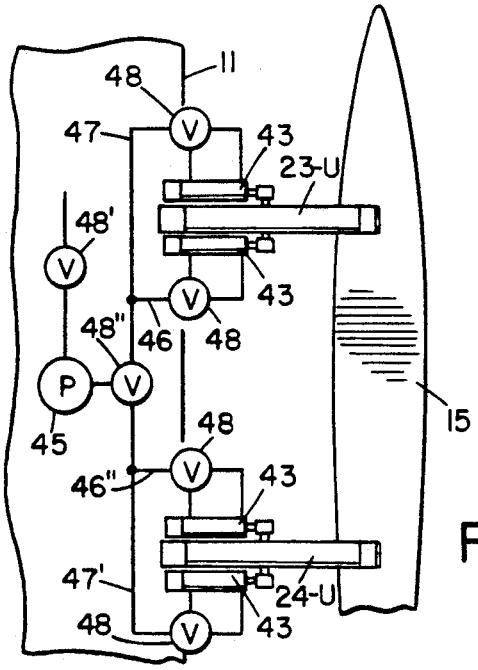
FIG. 6 is an upper plan view illustrating an exemplified layout of a starboard side catamaran bridgedeck region and the basic hydraulic control system.

While actual hydraulic line fittings are not illustrated in FIG. 5, the hydraulic hook-up is substantially conventional. FIG. 6 illustrates a preferred hydraulic feeder line layout in which a conventional hydroelectric, servo pump 45 that is controlled remotely via electric, normally open, momentary, double-pole, double-throw rocker-toggle type control switches at the bridgedeck, actuating suitable relay switch, control feeding four suitably sized 3-way normally closed solenoid valves 48. This enables the hydraulic rams 43 to be instantaneously expanded or withdrawn as required for convenient repositioning as desired. Additionally, it should be pointed out that since the described hydraulic control system is nulled as to fluid flow, either to the pump or even between respective control rams 43; then the port and starboard hulls are maintained very rigidly with the center bridgedeck structure. However, if cantering capability is not to be offered on a particular catamaran model, then solenoid valves 48' and 48'' that normally operate simulataneously with the other four valves 48, may be omitted since there would then be no need for them to be selected for discrete port or starboard suspension arm control.

Figure 7:
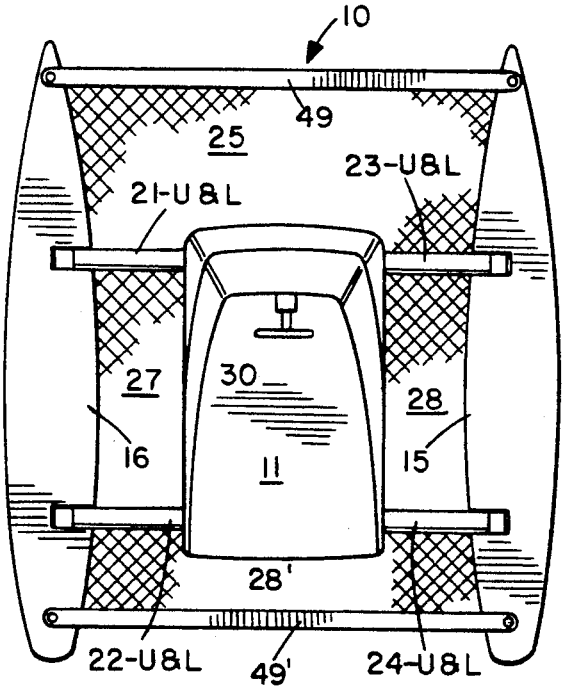
FIG. 7 is an exemplified upper plan view of the overall catamaran boat illustrating the general relationship of structural components.

FIG. 7 illustrates an exemplified plan view of the catamaran invention, wherein is also included optional bow beam forward 49 and stern beam aftward 49' for transverse reinforcement as to rigid lateral positioning of the hulls relative to the bridgedeck structure. The beams are preferably bolted or clamped distally atop the opposed hull sections 15 and 16, so that they may be readily detached just prior to retraction of the hulls. This provision being particularly appropriate to the more manually operated hull retraction installations, since the notion of the substantially automated hydraulically-powered adaptations of this catamaran boat invention is to virtually eliminate need for such time consuming laborious tasks.

While the present invention has been well described hereinbefore by way of preferred embodiments, it is to be realized that various changes, alterations, rearrangements, and obvious modifications may be resorted to by those skilled in the art to which it relates, without substantially departing from the implied spirit and scope of the instant invention. Therefore, the invention has been disclosed herein by way of example, not by any imposed limitation.

I claim:

1. An improved catamaran-type vessel having a special variable beam capacity for changing said catamaran-type structure to a substantially single hull type structure, comprising:

a central bridgedeck body and at least a pair of elongated flotation hulls, with each one of said hulls normally being positioned in a vertical attitude relative to the water surface on each side of said bridgedeck body;

suspension means pivotally interconnecting each of said hulls to said central body and positioning said hulls laterally from said central body;

power means for rotatably moving said suspension means and said hulls from said lateral position to a vertical position relative to the water surface, and underneath the central body;

said hulls being closely spaced horizontally and also being in said vertical attitude forming a lower joint hull for supporting said vessel relative to the water surface, said suspension means comprising a pair of hull suspension arms on each side of said bridgedeck body;

a pair of transversely spaced and tier-staggered port and starboard coupling means for anchoring adjacent ends of the hull suspension arms, for swinging from horizontally outward to vertically downward; and each of said hulls having dual transversely space, laterally tier-staggered upper pivot and lower pivot anchor points for coupling to the adjacent ends of said hull suspension arms, for moving said hulls in said horizontally outward to vertically downward movement of said suspension arms, and positioning said hulls in the vertical attitude relative to the water surface.

2. An improved catamaran-type vessel as claimed in claim 1 in which:

said hull suspension arms comprising a rigid structure from said coupling means to each of said hulls.

3. An improved catamaran-type vessel as claimed in claim 2 including:

means for locking said suspension arms together and preventing relative movement therebetween for locking the position of said arms and said hull to a substantially horizontal position.

* * * * *